United States Patent [19]

Schneider et al.

[11] Patent Number: 4,819,432

[45] Date of Patent: Apr. 11, 1989

[54] INSTALLATION FOR HARNESSING THERMAL ENERGY

[75] Inventors: Christian Schneider, Reuthgasse 7, D-8650 Kulmbach; Hans P. Doetsch, Neudrossenfeld; Helmut Krauss, Mainleus; Hans Höfer, Wallenfeld, all of Fed. Rep. of Germany

[73] Assignee: Christian Schneider, Kulmbach, Fed. Rep. of Germany

[21] Appl. No.: 111,788

[22] PCT Filed: Dec. 23, 1986

[86] PCT No.: PCT/EP86/00777

§ 371 Date: Aug. 21, 1987

§ 102(e) Date: Aug. 21, 1987

[87] PCT Pub. No.: WO87/03932

PCT Pub. Date: Jul. 2, 1987

[30] Foreign Application Priority Data

Dec. 23, 1985 [DE] Fed. Rep. of Germany ..... 3545936

[51] Int. Cl.[4] ..... F02G 1/04

[52] U.S. Cl. ..... 60/525; 60/519

[58] Field of Search ..... 60/517, 519, 525, 526, 60/721; 62/6

[56] References Cited

U.S. PATENT DOCUMENTS

| | | | |
|---|---|---|---|
| 1,926,463 | 9/1933 | Stoddard . | |
| 3,115,014 | 12/1963 | Hogan | 62/6 |
| 3,487,424 | 12/1969 | Leger | 62/6 |
| 3,830,059 | 8/1974 | Spriggs | 60/520 |
| 4,103,491 | 8/1978 | Ishizaki | 60/519 |
| 4,179,890 | 12/1979 | Hanson | 60/519 |

FOREIGN PATENT DOCUMENTS

| | | |
|---|---|---|
| 1751704 | 8/1971 | Fed. Rep. of Germany . |
| 3536710 | 4/1987 | Fed. Rep. of Germany . |
| 2409378 | 6/1979 | France . |
| 1181533 | 2/1970 | United Kingdom . |

*Primary Examiner*—Stephen F. Husar

*Attorney, Agent, or Firm*—Holtz, Goodman & Woodward Frishauf

[57] ABSTRACT

In an installation for harnessing thermal energy, in which in a first part of an operating cycle the working fluid is positively displaced out of a first chamber into a second chamber, in which a higher temperature prevails than in the first, and in a second part of the operating cycle working fluid is positively displaced from the second chamber back into the first chamber, wherein thermal energy is supplied to the working fluid on its passage from the first to the second chamber and removed from the working fluid on its passage from the second to the first chamber, the chambers are formed by variable-volume working chambers of piston machine units (10, 12, 14, 16) coupled with one another and operating out of phase with one another, which communicate with one another by fluid ducts (18, 20, 22, 24) in such a way that the working fluid is positively displaced out of a shrinking work chamber having a relatively high temperature through a first duct, into an expanding work chamber having a lower temperature, and at the same time, working fluid from a shrinking work chamber having a lower temperature is positively displaced through a second duct into an expanding work chamber having a higher temperature. The piston engine units each operate as an entity at a predetermined temperature level, so that problems with respect to the thermal insulation cannot arise.

18 Claims, 16 Drawing Sheets

T4
(H)
T3
(M)
T2
T1
(L)
1
2
4
3
4
1
3
2

360°

450°

540°

630°

INSTALLATION FOR HARNESSING THERMAL ENERGY

BACKGROUND

In the older German Patent Application No. P 35 36 710.5, an installation for harnessing thermal energy operating as a heat converter has been proposed, having a substantially cylindrical housing that includes three chambers, which are at different temperatures. Two positive displacement regenerators are disposed in the housing, which are moved by a gear either in alternation or with phase displacement, in such a way that with cyclic repetition, (a) gaseous working fluid, such as helium, is transferred by the first positive displacement means from the middle work chamber, which is at a temperature in a predetermined, medium temperature range, into a "hot" working chamber, which is at a temperature in a higher temperature range than the first, and thermal energy is supplied to the transferred gas;

(b) working fluid is transferred by the second positive displacement regenerator from the middle work chamber into a "cold" work chamber, which is at a temperature in a relatively low temperature range, which is lower than the first temperature, and thermal energy is removed from the transferred working fluid;

(c) working fluid is transferred by the first positive displacement regenerator from the hot work chamber into the middle work chamber, and thermal energy is removed from the transferred working fluid;

(d) working fluid is transferred by the second positive displacement means from the cold work chamber into the middle work chamber, and thermal energy is supplied to the transferred working chamber; and (e) working fluid is transferred by the first and second positive displacement regenerators from the hot work chamber into the cold work chamber, and thermal energy is removed from the working fluid.

A disadvantage of the proposed heat converter is that the work chambers located at different temperatures are located in the same housing and therefore cannot be completely thermally insulated from one another, which results in heat losses and hence a reduction in efficiency.

From German Patent Document DE-A-No. 32 37 841, a thermally operated heat pump is known, which comprises two identical units each having a high-temperature and low-temperature working cylinder with corresponding positive displacement pistons, the periodic reciprocation of which is out of phase by 90° with one another, while the phases of the corresponding positive displacement pistons in the two units are displaced by 180° from one another. Both units each include a constant volume that is hermetically sealed off from the outside and is filled with compressed gas, heat at a relatively high temperature is supplied to both high-temperature cylinders, while a much greater heat at a lower temperature is supplied to the low-temperature cylinders, and the waste heat of all four cylinders is removed as useful heat. For the high-temperature cylinder, a countercurrent heat exchanger is provided, the two pipe systems of which connect the upper work chambers with the lower work chambers. The work chambers, separated by the positive displacement means, of the two low-temperature cylinders communicate with one another by means of the separate pipe systems of a second heat exchanger. Once again, however, a temperature difference must be maintained along the cylinders, so that once again problems arise with respect to the thermal insulation.

THE INVENTION

It is accordingly the object of the present invention to devise an installation of the above-described generic type, in which there are no problems in terms of the thermal insulation of the various work chambers.

The present invention is accordingly based on a heat converter in which in a first part of an operating cycle the working fluid is positively displaced out of a first chamber into a second chamber, in which a higher temperature prevails than in the first, and in a second part of the operating cycle working fluid is positively displaced from the second chamber back into the first chamber, wherein thermal energy is supplied to the working fluid on its passage from the first to the second chamber and removed from the working fluid on its passage from the second to the first chamber. In an embodiment of the invention, two first work chambers at the higher temperature and two second work chambers at the lower temperature are provided, which are formed by corresponding variable-volume work chambers of piston engine units that are coupled to one another and operate out of phase with one another. The work chambers of the piston engine units communicate with one another through fluid ducts in such a way that the working fluid is positively displaced out of a work chamber of a first piston engine unit, which is at relatively high temperature and is decreasing in size, through a first duct into a work chamber of a second piston engine unit, which is at a relatively low temperature and is increasing in size, and at the same time working fluid is positively displaced out of a work chamber at low temperature that is decreasing in size through a second fluid duct into a work chamber at a higher temperature that is increasing in size, and that the two fluid ducts are thermally coupled through a heat exchanger. This installation operates substantially with the cyclical process proposed. The piston engine units, in accordance with the invention, each have a housing that operates substantially at the same temperature level everywhere and includes a rotary or reciprocating piston, which with the housing forms at least two work chambers in which substantially the same temperatures prevail.

Preferred embodiments of the invention include four synchronously operating piston engine units, of which one operates at the high temperature and one at the relatively low temperature and two operate at the medium temperature. With the invention, installations can be realized that operate as a heat pump and/or heat transformer and optionally also furnish and/or consume mechanical work.

Exemplary embodiments of the invention are described in further detail below, referring to the drawings; in this description, still other characteristics and advantages of the invention will be discussed.

DRAWINGS

Shown are:

FIG. 1, including FIGS. 1A–1H, schematic illustrations of eight operating phases of a first embodiment of the invention, in the form of a rotary piston heat converter, which operates with four mechanically and thermally coupled thermodynamic gas-cycle processes;

FIG. 2, schematic views of some corresponding operating phases of the aforementioned proposed heat converter;

FIG. 3 and 4, a pressure/time diagram and volume/-time diagram, respectively, which will be referred to in the explanation of the mode of operation of the heat converter of FIG. 1;

FIG. 5, including FIGS. 5A–5D, illustrations corresponding to FIGS. 1A, 1C, 1E and 1G, respectively, of a second embodiment of the invention;

FIG. 6, comprising FIGS. 6A–6H, schematic illustrations corresponding to FIGS. 5A–5D of a third embodiment of the invention;

FIG. 7, including FIGS. 7A–7H, illustrations of an embodiment of the invention that can be used as a motor, in various operating states corresponding to FIGS. 5A–5D;

FIG. 8, a graphic illustration of the volumes that the operating gas masses (bl), (or), (ge), (ro), (br) or (gr) referred to in the description of FIG. 7 assume during one rotor revolution;

FIGS. 9 and 10, a pressure/volume (p/v) diagram and a temperature/entropy (T/S) diagram for the thermodynamic process evolving in the installation of FIG. 7;

FIG. 11, including FIGS. 11*a*–11*h*, schematic illustrations of operating phases of a preferred embodiment of the invention, operating with reciprocating piston units;

FIG. 12, a diagram of the pressure that prevails in one of two separate working fluid systems of the installation according to FIG. 11, as a function of the crankshaft angle;

FIG. 13, a portion of a drive apparatus for the installation of FIG. 11; and

FIG. 14, including FIGS. 14A–14C, a simplified illustration of an embodiment of the invention that can be used as a motor.

DETAILED DESCRIPTION

In realizing the invention, both reciprocating piston engine units, having a reciprocating piston supported tightly and displaceably in a cylinder, and any known positive displacement rotary piston engine constructions (which should also be understood to include rotary valve engines) can be used, such as are used in many forms as pumps, compressors, and so forth. Accordingly, the mechanical construction will be described only to the extent that it is significant for the present invention. However, it will be noted that in the piston engine units that are used in the installation according to the invention and which in principle each take on part of the function of a positive displacement means, generally neither significant mechanical compression of the working fluid, nor significant expansion of the working fluid which performs external work, takes place. However, pressure differences do arise at the piston, so that the piston must be sealed off with respect to the associated cylinder or housing by means of piston rings, sealing strips, and the like. The forces that act upon a piston because of the pressure difference, however, can be compensated for in a simple manner, by coupling the pistons of two synchronously operating units mechanically with one another.

A highly suitable construction of a rotary piston engine for realizing the invention, shown in highly simplified form in FIG. 1, includes a housing having a cylindrical inner wall, forming a rotor chamber, in which a rotor having a cylindrical outside is coaxially disposed, forming an intermediate chamber with the inner wall of the housing. The intermediate chamber has substantially constant radial dimensions. The rotors have slides or "blades", which may for example each comprise a strip-like protrusion of the rotor outside; each protrusion is connected to the rotor, extends axially with its longitudinal direction and extends radially toward the inner wall of the housing, with respect to which it is sealed off by sealing strips or the like. The required seal that is stationary with respect to the housing, between the rotor and the housing, may comprise a sealing slide that is supported radially displaceably in the inner housing wall, rests in a sealing manner on the cylindrical outside of the rotor and is pressed by a beveled edge of the strip-like protrusion in a position substantially aligned with the inner housing wall, whenever the strip-like protrusion moves past this seal. As will also be explained in conjunction with FIG. 6, however, rotary piston engine constructions that include a rotary piston not having a circular cross section can also be used.

The embodiment of the invention shown schematically in FIG. 1 can be called a rotary piston heat converter and includes four rotary piston engine units (10), (12), (14) and (16). When this installation typically operates as a heat pump, the unit (10) operates in a relatively high temperature range (H), while the unit (16) operates in a relatively low temperature range (L) and the units (12) and (14) operate in a medium temperature range (M) located between them. The rotary piston engine units can each include separate, substantially cylindrical housings, which can be provided on the outside with ribs or the like and/or on the inside with heat exchanger conduits, in order to form a large heat transmission surface area and to assure good heat transmission with a corresponding external heat transfer fluid. The housings each include a rotor chamber having a rotor. The rotors of the units (10) through (16) can be mounted on the same shaft or may be driven synchronously in some other manner. The units (10) and (16) are thermally insulated to the maximum possible extent from the units (12) and (14). The units (12) and (14) can be accommodated in the same housing, if they operate at the same temperature, but even in this case the working chambers (rotor chambers) of the two units are separate.

In the embodiment of FIG. 1, each unit has one rotor having two diametrically disposed slides or blades (13), as indicated by a radial line, and one stationary seal (11), indicated by a black wedge, attached to the inner housing wall and effecting sealing between the inner housing wall and the outer rotor surface.

Each rotary piston engine unit has three connections for corresponding conduits or ducts carrying a gaseous working fluid, specifically, one connection (10*a*), (12*a*), (14*a*) and (16*a*), which is located diametrically opposite the respective stationary seal, one connection (10*b*), (12*b*), (14*b*) or (16*b*), which upon clockwise rotation of the rotors is located directly in front of the seal (13), and finally, one connection (10*c*), (12*c*), (14*c*) or (16*c*), which are located directly behind the seal (13) in the direction of rotation. The slides or blades (11) of the rotors are dimensioned in such a way with respect to the openings, such as (10*b*), (10*c*), adjacent to the stationary seal (13), that as they move past these openings they close both of them simultaneously.

A branching duct (18) connects the connections (10*a*), (14*b*) and (16*c*). A branching duct (20) connects the connections (10*b*), (12*c*) and (16*a*). A branching duct (22) connects the connections (10*c*), (12*b*) and (14*a*). A branching duct (24) connects the connections (12*a*), (14*c*) and (16*b*).

The portion of the duct (18) adjacent to the connection (10*a*) and the portions of the ducts (20 and 22) leading from the various branches to the connections (10*b*) and (10*c*) lead through a first heat exchanger (26). The portion of the duct (20) adjacent to the connection (16*a*) and the portions of the duct (18) and (24) leading from the branch to the connections (16*b*) and (16*c*) lead through a second heat exchanger (28).

Alternatively, the portions of the ducts (18) and (20) adjacent to the connections (10*a*) and (16*a*), respectively, may not lead through the heat exchangers (26) and (28), respectively, but instead may be coupled thermally to one another by their own heat exchanger (29).

preferably, as indicated by the rectangles (30) and (32) drawn in dashed lines, one heat exchanger each (30) and (32) is provided between the portion of the duct (24) adjacent to the connection (12*a*) and the portion of the duct (18) adjacent to the branch, and between the portion o the duct (22) adjacent to the connection (14*a*) and the portion of the duct (20) adjacent to the branch, respectively.

The work chambers formed by the rotary piston engine units and the ducts contain a gaseous working fluid, such as helium. In a typical mode of operation of the installation according to the FIG. 1 as a heat pump or refrigerating machine, the rotors of the units are driven clockwise synchronously. The unit (10) is supplied with high-quality thermal energy at high temperature (H), the unit (16) absorbs thermal energy at low temperature (L), while the units (12 and 14) emit thermal energy at medium temperature (M), which represents useful heat in operation as a heat pump and waste heat in operation as a refrigerating machine in general.

The heat converter according to FIG. 1 includes four systems that are separate in terms of the gas they contain, in which four thermodynamic gas cycle processes, out of phase with one another, take their course. In the work chambers, communicating through the various ducts (18), (20), (22) and (24), of the various systems, substantially the same pressure prevails, which is variable over time. From one system to another, however, the pressure is generally different. In the ensuing description, for the sake of simplicity, the systems will be represented by the symbol "(S)" with the particular duct number added. In FIG. 1, the working fluid masses that are separate from one another in the various systems are represented by different kinds of shading; specifically,

- the working fluid of the system (S18) associated with the duct is represented by vertical shading[red];
- the working fluid of the system (S20) associated with the duct is represented by shading slanted to the right [green];
- the working fluid of the system (S22) associated with the duct is represented by horizontal shading[blue]; and
- the working fluid of the system (S24) associated with the duct (24) is represented by broken vertical/-horizontal cross hatching [yellow].

In the phase shown in FIG. 1A, the working fluids of the various systems are each located substantially in only two units (in the ensuing description, the working fluid present in the ducts is ignored):

(S18) in the units (10) and (14);
(S20) in the units (10) and (16);
(S22) in the units (12) and (14);
(S24) in the units (12) and (16).

In a heat converter of the kind proposed in the aforementioned older Patent Application, the status of the system would correspond to the positions shown in FIG. 2 of the positive displacement regenerators represented by an X; that is, (S18), position I; - (S20), position II;
(S22), position IV, and - (S24), position III.

FIG. 1B shows the status of the systems once the rotors have rotated clockwise by approximately 45°. Some of the volumes of the work chambers remain unchanged during the first 180° of the rotation, specifically the following:

the work chamber of (S18) in the unit (10);
the work chamber of (S20) in the unit (16);
the work chamber of (S22) in the unit (14); and
the work chamber of (S24) in the unit (12).

In the unit (10), the work chamber occupied by the working fluid of the "green" system (S20) becomes successively smaller, so that the working fluid flows through the connection (10*b*), through the heat exchanger (26) and the connection (12*c*) into the unit (12), where adjoining the connection (12*c*) a correspondingly expanding work chamber is formed. Simultaneously, from the unit (12), working fluid of the "blue" system (S22) is positively displaced through the connection (12*c*), the heat exchanger (26) and the connection (10*c*) into the unit (10), in which a correspondingly expanding work chamber is formed adjoining the connection (10*c*). In this process, the working fluid of the system (S20) positively displaced out of the unit (10) into the unit (12) gives up heat in the heat exchanger (26) to the working fluid of the system (22) positively displaced from the unit (12) into the unit (10).

In a corresponding manner, working fluid of the "red" system (S18) is positively displaced out of the unit (14) through the heat exchanger (28) into the unit (16), while at the same time working fluid of the "yellow" system (S24) is positively displaced out of the unit (16) through the heat exchanger (28) into the unit (14), so that once again a corresponding heat exchange can take place in the heat exchanger (28).

Since the temperature of the particular positively displaced working fluid varies, the pressure in the applicable system varies as well, and correspondingly some working fluid also flows through the applicable duct into or out of the particular unit in which the volume of the work chamber of the applicable system does not change.

The further course of the operating cycle should be readily understandable based on the above explanation, with reference to FIGS. 1C through 1H. At the end, the status shown in FIG. 1A is once again attained.

FIG. 3 shows the changes in pressure that take place in the individual systems when practical values are assumed for the temperatures of the units (10), (12)+(14) and (16). The pressure in the system (S18), the course of which is represented by the curve drawn in a solid line having one arrow, drops between ($t_o$) and ($t_1$) in accordance with the transition from FIG. 1A to FIG. 1C, because working fluid at medium temperature (M) is positively displaced out of the unit (14) operating at the medium temperature (M) into the unit (16) in which a relatively low temperature (L) prevails. Between ($t_1$) and ($t_2$), the pressure drops relatively sharply, because at the transition from FIG. 1C to FIG. 1E the working fluid is positively displaced out of the unit (10) that operates at the relatively high temperature (H) into the unit (12) located at the medium temperature (M), and a greater change in temperature takes place than at the transition between (14) and (16). The temperature changes between ($t_2$) and ($t_3$) as well as between ($t_3$) and ($t_4$) correspond to the operating phases between FIGS. 1E and 1G, on the one hand, and between FIGS. 1G and 1A on the other. The course of the pressure in the other systems is represented by the curves provided with two, three or four arrows and the system designation.

In FIG. 4, in a fashion analogous to FIG. 3, the changes in the working volume formed by the units (10) through (16) are shown for the systems (S18) through (S24). It is apparent that the sum of the working volumes formed by the four units (10) through (16) is constant over time for each system.

FIGS. 5A–5D show four operating phases of an installation that represents a modification of the heat converter of FIG. 1 and differs from the latter substantially only in that each unit has a rotor having four slides or blades offset by 90°, and that two diametrically offset seals are provided between the housing and the rotor, so that for the various systems in each unit, two diametrically opposed work chambers each are formed, as is represented by the corresponding shadings in the drawing. The work chambers of each unit that are diametrically opposed to one another are provided with corresponding connections, which are connected in pairs to the corresponding ducts (18) through (24). This is shown in FIG. 5A only for the unit (10), for the sake of simplicity: In each case, two diametrically opposed connections (10*a*1), (10A*a*) are provided, which are located in the middle between the seals (11*a*, 11*c*) that are stationary with respect to the housing. Two diametrically opposed pairs of connections, (10*b*1), (10*c*1), and (10*b*2), (10*c*2), are each provided, offset by the angular spacing of the rotor blades or in other words by 90°. from these connections, and are associated with the seals (11) in the manner that has been explained in conjunction with FIG. 1. The same reference numerals are otherwise used as in FIG. 1, and the mode of operation of the heat converter shown in FIG. 5 is entirely analogous to that of FIG. 1.

The thermodynamic cycle processes taking place in the installations of FIGS. 1 and 5 differ from the proposed process and from the so-called Vuilleumier process substantially in that the quantity of heat supplied to or removed from a gas mass (m) on a path from (x) to (y) by a regenerator is no longer supplied to or removed from the total mass (m) upon flowing back from (y) to (x), but instead is supplied to or removed from a portion of (m).

In FIG. 6, a modification of the installation of FIG. 1 is schematically shown, in which novel rotary piston engine units (610), (612), (614), (616) are used, each containing one rotary piston (602) in the form of a three-pointed star, which revolves eccentrically in a rotor chamber (604) shaped like a four-cornered pillow the sides of which are drawn inward somewhat. Once again, there are four systems, in which four thermodynamic gas processes of the type explained in conjunction with FIG. 1 take place out of phase with one another. A duct (618) is associated with the "red" system (S618); a duct (620) is associated with the "green" system (S620); a duct (622) associated with the "blue" system (S622); and a duct (624) is associated with the "yellow" system (S624). The rotor chambers of the units (610), (612), (614) and (616) each have a connection in their corners for one of the ducts (618), (620), (622) or (624). The connections are each designated by the numbers of the unit and the letters (a), (b), (c) and (d), beginning at the top right and proceeding clockwise, and are connected with the ducts as follows:

connections (610*a*), (612*c*), (614*b*), (616*d*) connected with (618);

connections (610*b*), (612*d*), (614*c*), (616*a*) connected with (620);

connections (610*c*), (612*a*), (614*d*), (616*b*) connected with (624);

connections (610*d*), (612*b*), (614*a*), (616*c*) connected with (622).

While in the connections of the rotor chambers of the units of the installation according to FIG. 1 the working gas always flows only either out or in, in the installation according to FIG. 6 the working gas flows through one and the same connection into the rotor chamber during part of the operating cycle and out of the rotor chamber during another part of the operating cycle. Accordingly, in place of the heat exchangers (626) or (628), which correspond in function to the heat exchangers (26) or (28) of FIG. 1, a corresponding regenerator (or recuperator) can be used in each duct. The mode of operation of the installation of FIG. 6 otherwise corresponds to that of FIG. 1, so that further explanation is unnecessary. The embodiment according to FIG. 6 is less complicated mechanically than that of FIG. 1 and is intended primarily to show that the invention can be realized with rotary piston engine units of the most various structural types.

Since in the above-described installation practically no mechanical compression of the working gas takes place, practically the only power needed for driving the rotors is that needed to overcome the friction losses and any possible thermally-dictated pressure differences.

As has already been mentioned above in conjunction with FIG. 1, the aforementioned installations can be used as a heat pump or refrigerating machine. In a typical mode of operation, the rotors rotate clockwise, and heat is supplied to the units (10) or (16) operating at a high temperature (H) or low temperature (L), respectively, and heat is removed from the units (12) and (14) operating at a medium temperature. However, the units (12) and (14) can also be operated with different temperatures (T3) or (T2), where (T3) may be higher or lower than (22), without any change in the principle of the operation of the installation as a heat pump or refrigerating machine.

The installations according to FIG. 1, 5 and 6 may also be operated in a different manner from that of heat pumps (or refrigerating machines) and may also be operated as a heat transformer or as a heat pump transformer. A total of eight types of operation are possible, which are shown in Table I below. A plus sign (+) means that thermal energy is supplied to the unit named in column 1, while a minus sign (−) means that thermal energy is given up by or removed from the particular unit.

TABLE I

| Mode of Operation: | 1 | 2 | 3 | 4 | 5 | 6 | 7 | 8 |
|---|---|---|---|---|---|---|---|---|
| Unit: 10 | + | + | + | + | − | − | − | − |
| 12 | + | − | − | − | − | + | + | + |
| 14 | − | − | + | + | + | − | − | + |
| 16 | + | + | − | + | − | + | − | − |

The above table applies for rotor rotation in the clockwise direction. In the event of counterclockwise rotor rotation, the symbols (+ or −) for the heat flows are reversed.

The mode of operation 2 has been explained above in conjunction with FIG. 1. It should be noted that in this mode T3 can be greater than, equal to or smaller than T2. T4 is greater than T3 and T2, and these temperatures are greater than T1.

The modes of operation 1 and 3 are particularly advantageous heat pump or refrigerating machine modes, because in mode or type 1, useful heat is given off at two different temperature levels T4 and T3, while in mode 3 cold can be generated at a relatively low level T1 and at a somewhat higher level.

Mode 8 represents a heat transformer. The unit 10 gives up useful heat at the relatively high temperature T4, and the unit 16 gives up waste heat at the relatively low temperature T1, while the units 12 and 14 absorb heat at the medium temperature T3 or T4, and

T4>T3>/=/<T2>T1.

In modes 3 and 6, the installation operates as a heat pump transformer. In this case, the following relationships exist among the temperature levels:

Mode 3: T3>T4>T2>T

Mode 6: T4>T3>T1>T2

The heat pump transformers are suitable above all for the recovery of heat in condensation processes. The heat of condensation liberated when a substance is condensed is supplied to the heat pump transformer and transformed upwards by it to a temperature that is above the temperature of condensation, so that it can be harnessed for evaporating the substance in question.

Further advantageous modifications result if the installations of FIGS. 1, 5 or 6 are supplemented with a compression machine (KM) and/or and expansion machine (EM). In FIG. 1, the expansion machine (EM) is incorporated into the duct (18) at the connection (10*a*), and it can for instance be used for providing the drive energy required for driving the rotors of the units (10) through (16). The compression machine (KM) is incorporated into the duct (20) at the connection (16*a*) and permits supplying additional energy to the system by means of mechanical work.

With a compression or expansion machine, the 22 types or modes listed in Table II result; a plus symbol in line (W) means that work is supplied to the system via a compression machine (KM), while a minus sign in this line represents the removal of energy from the system by an expansion machine (EM). With respect to the units (10) through (12), Table II corresponds to Table I.

TABLE II

| | Mode of Operation: | | | | | | | | | | | | | | | | | | | | | |
|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
| W | + | + | + | + | + | + | + | + | − | − | − | − | − | − | − | − | + | + | + | + | + | + |
| Unit 10 | + | + | + | + | − | − | − | − | + | + | + | + | − | − | − | − | − | − | − | + | + | + |
| 12 | + | − | − | − | − | + | + | + | + | − | − | − | − | + | + | + | + | − | − | − | + | + |
| 14 | − | − | + | + | + | − | − | + | − | − | + | + | + | − | − | + | + | + | − | − | − | + |
| 16 | + | + | − | + | − | + | − | − | + | + | − | + | − | + | − | − | + | + | + | − | − | − |

In FIG. 7, an exemplary embodiment of the present installation is shown, with which thermal energy can be converted into mechanical work, in particular into shaft output of a turbine. The installation according to FIG. 7 includes two rotary piston engine units (710) and (712), which can have substantially the same structure as that explained in connection with FIG. 1. The units each include three rotor chamber connections (710*a*), (710*b*) and (710*c*), and (712*a*), (712*b*), (712*c*), respectively, which are arranged in the manner described for the corresponding connections in FIG. 1. The connections (710*a*) and (712*a*) communicate via a duct (717), which contains a work-performing expansion machine, such as a turbine (719). The connection (710*b*) communicates with the connection (712*c*) via a duct (721). The connection (712*b*) communicates with the connection (710*c*) via a duct (723). The ducts (721) and (723) lead through a heat exchanger (726). Furthermore, the ducts (717) and (723) can be thermally coupled by means of a heat exchanger (728). Optionally, all or some of the gaseous working fluid flowing the duct (717) can be carried through the heat exchanger (726), as indicated by broken ducts. During operation, the unit (710) is supplied with thermal energy at relatively high temperature ($T_H$), and thermal energy at relatively low temperature ($T_L$) is removed from the unit (712). The rotors of the units (710) and (712) are mounted on a common shaft or are driven in synchronism in some other manner, and once again substantially only the mechanical friction losses need to be covered, because the torques arising from pressure differences in the units compensate for one another.

FIGS. 7A–7H shows various operating states during one revolution of the rotors of the units (710) and (712). In the units (710) and (712), four thermodynamic gas cycle processes that are out of phase with one another take place. It is characteristic of the installation of FIG. 7 that a certain volume of the working gas simply shuttles back and forth between the units (710) and (712), while another part of the volume is pumped through the turbine (719) by this "shuttle volume" and there performs mechanical work. For an explanation of this process, first the working gas must be considered, which is located in left half of the unit (712*d*) between the blade (712*d*) [sic] and the seal (712*e*). When the -rotors rotate clockwise, the gas is positively displaced out of the relatively cold unit (712) through the duct (723) into the relatively hot unit (710).

In the position according to FIG. 7C, this process has been completed; that is, the left half of the unit (710) contains only working gas at relatively high pressure. The blade (710*d*) now overtakes the opening (710*a*) (FIG. 7C), so that the working gas that is at the relatively high pressure flows through the duct (717) to the turbine (719), where it expands and then flows into the work chamber, communicating with the opening (712*a*), of the unit (712) (see FIG. 7D), where it compresses the "brown" working gas volume, which is at a relatively low temperature and has a low density, somewhat compressed, as represented by the "orange" part (or). In FIG. 7E, the piston (712*d*) reaches the connection (710*a*), so that the outflow of working gas at relatively high pressure from the portion of the work chamber located in front of this piston is terminated. This portion of the work chamber now contains a "blue" working gas volume (b1), which has been expanded by the outflow of the "orange" portion (or). The working gas volume (b1) is now, between 7E and 7H, transferred into the portion located between the seal (712*e*) and the blade (712*d*), and the pressure drops as a result of the flowering of temperature. In FIG. 7G, this process has been completed.

It is thus apparent that the "blue" volume (b1) shuttles back and forth only between the units (710) and (712), but by intermittent expansion drives the other, "orange" portion (or) of the working gas and pumps it through the turbine, in order to perform mechanical work there. Naturally the working gas in the "blue" and "orange" volumes are not separated from one another; the above explanation is intended only to make clear that a certain percentage of the working gas shuttles back and forth between the units (710) and (712), while another portion is pressed by the first portion through the turbine, in order to generate the desired shaft output. This mass component $m_C$ depends on the temperature levels $T_H$ and $T_L$ in the units (710) and (712).

Entirely different processes take place with a corresponding phase displacement in terms of the "yellow" shuttle volume (ge) and the "red" working volume (ro). While in the above-described process the volume (or) was pumped cyclically through the turbine by (b1) or (br), in the second process offset by 180° from the first, the gas volume (ro) is pumped by the volumes (ge) or (gr) through the turbine. An installation of the type shown in FIG. 7 can be made with a very compact structure; the rotary piston engines and the turbine can be accommodated in one and the same housing, for instance of cylindrical shape, which on its outside then merely has suitable heat exchanger surfaces, along with electrical connections for drawing power, if the turbine is connected to an electrical generator.

If the turbine (719) is replaced by a compressor having an opposite feed direction, the result is a heat pump or refrigerating machine.

Figures 1A, 1B, 1C:
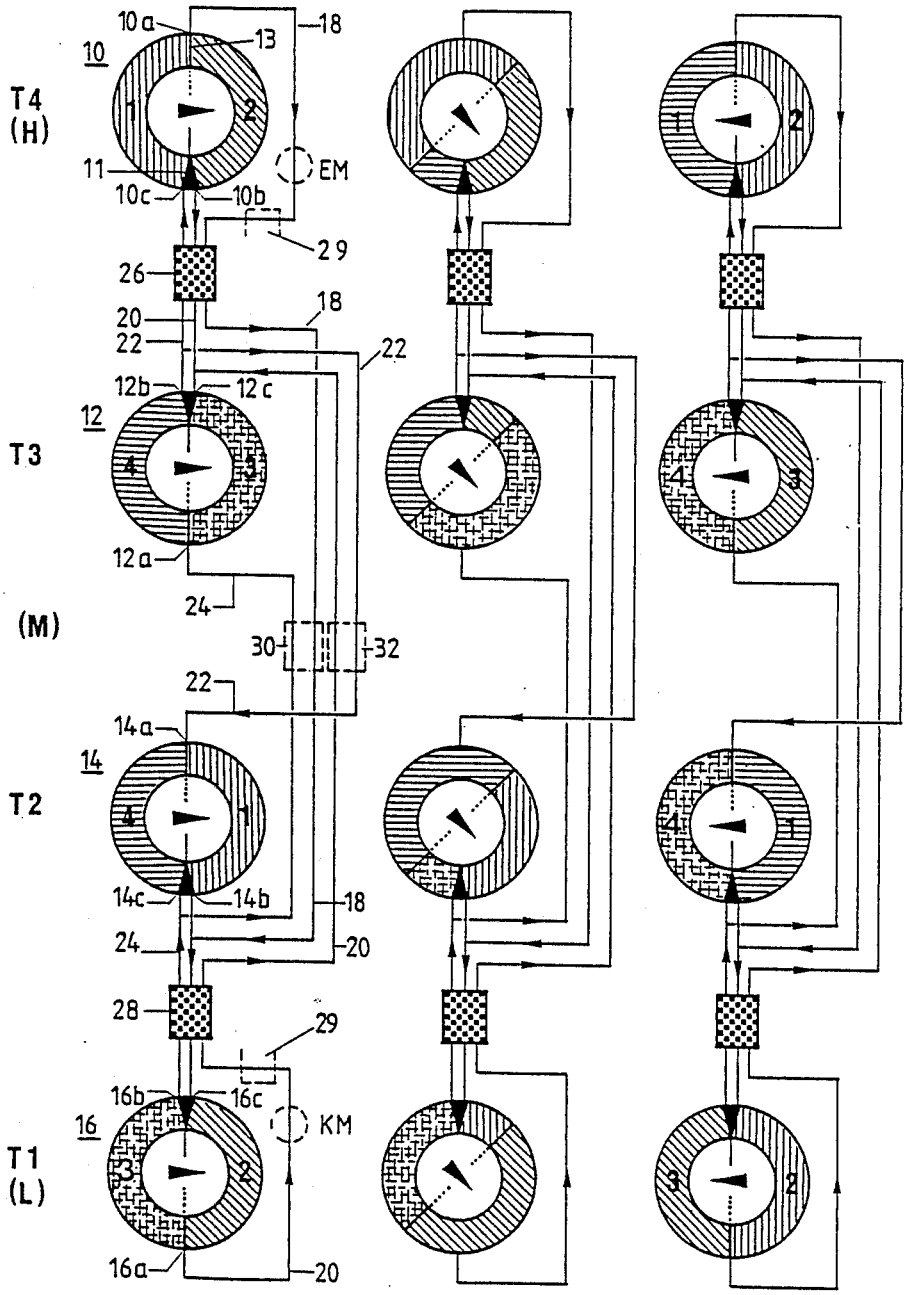

The embodiment according to FIG. 11 includes four reciprocating piston units (810, 812, 814, 816), each of which has a cylinder and a piston (K) displaceably supported in the cylinder. The pistons are sealed off with respect to the inner wall of the respective cylinder, for example by means of O-rings, because a pressure difference arises there during operation of the installation. The pistons of the units (810) and (812) as well as of the units (814) and (816) are rigidly coupled with one another via a gear unit (G), which will be explained in further detail with reference to FIG. 13, so that they execute synchronized reciprocating movements in the various cylinders.

The unit (810) operates at a relatively high temperature level (H), and the units (812) and (814) operate at a medium temperature level ($M_1$) and ($M_2$), which may be the same or may be somewhat different from one another. The unit (816) operates at a relatively low temperature level (L).

A first working fluid duct (818) connects connections (810*a*, 812*d*) to the opposed "outer" ends of the cylinders of the units (810) and (812), as well as connections (814*b*, 816*a*) at the "inner" ends facing one another of the cylinders of the units (814) and (816), respectively. In a corresponding manner, a second working fluid duct (820) joins connections (810*b*, 812*a*) to the "inner" ends, facing one another, of the units (810, 812) and connections (814*a*, 816*b*) at the "outer" ends, facing one another, of the units (814) and (816), respectively. The parts of the ducts (818, 820) connecting the connections (810*a*) and (812*b*) as well as the connections (810*b*) and (812*a*) are thermally coupled to one another through a heat exchanger (826) Correspondingly, the portions of the working fluid ducts (818, 820) extending between the connections (814*b*) and (816*a*), on the one hand, and between the connections (814*a*) and (816*b*), on the other, are thermally coupled to one another through a heat exchanger (828).

Figures 1D, 1E, 1F:
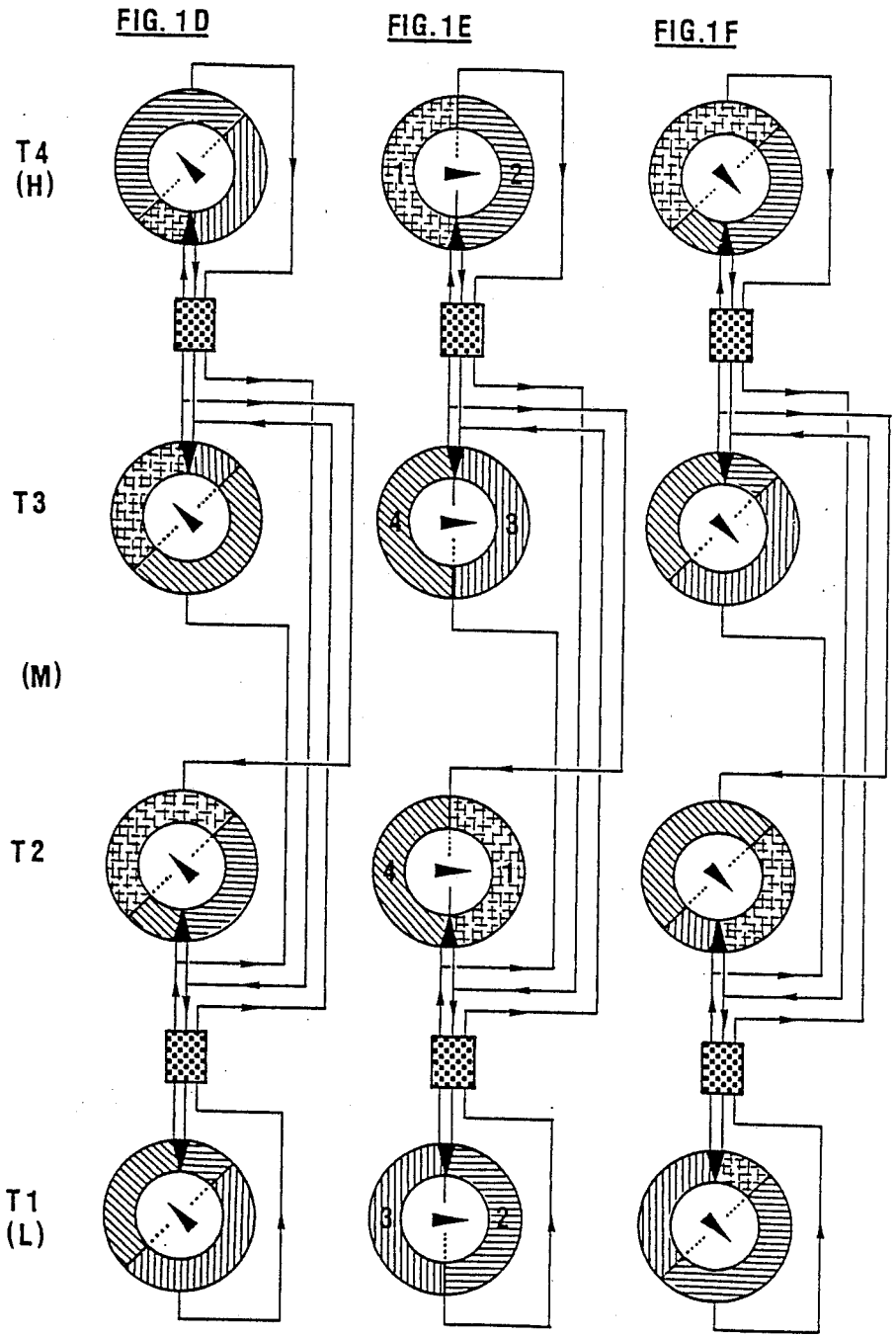
Figures 1G, 1H, 1I:
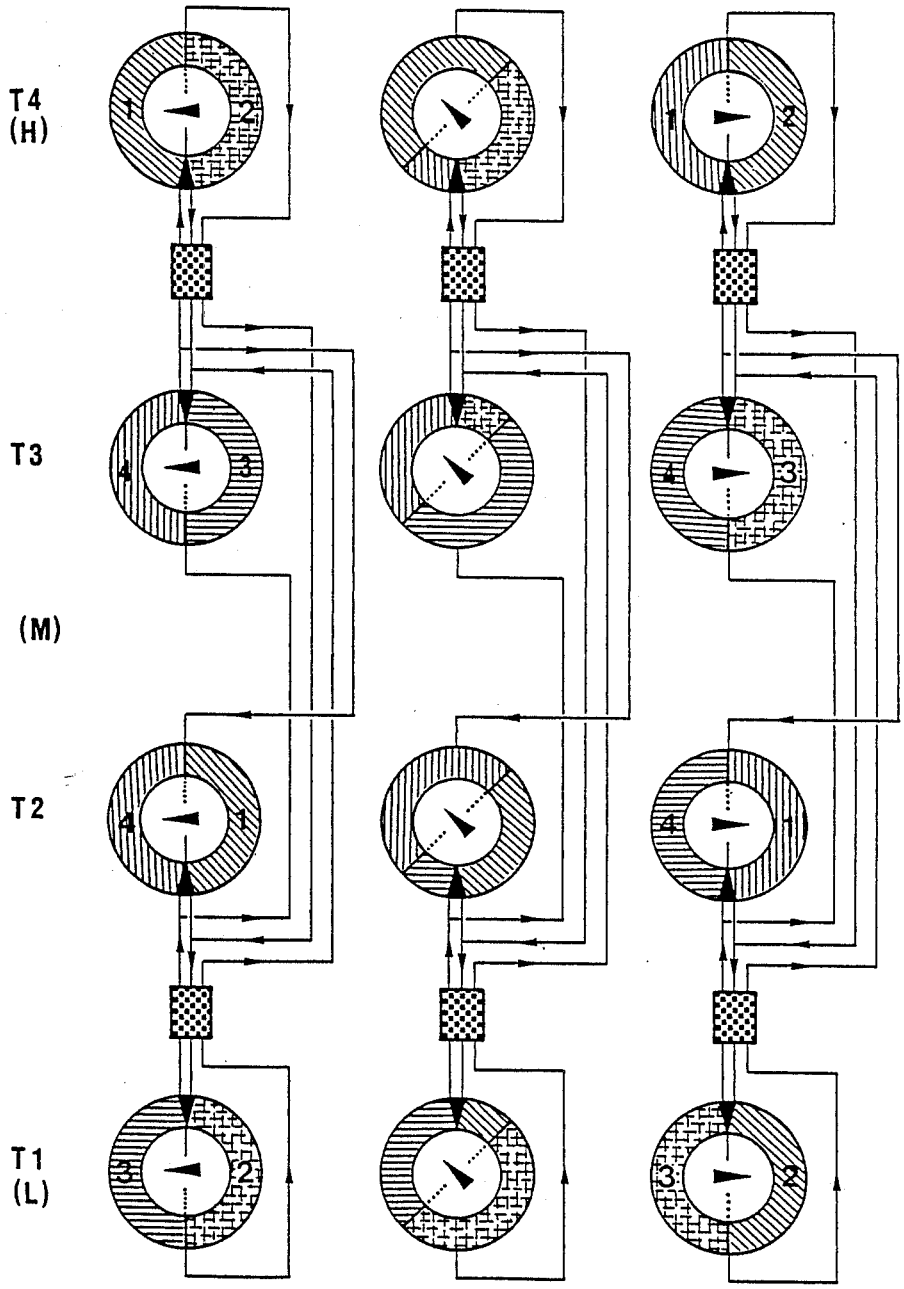
Figure 2:
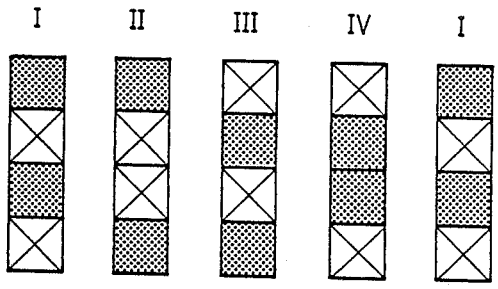
Figure 4:
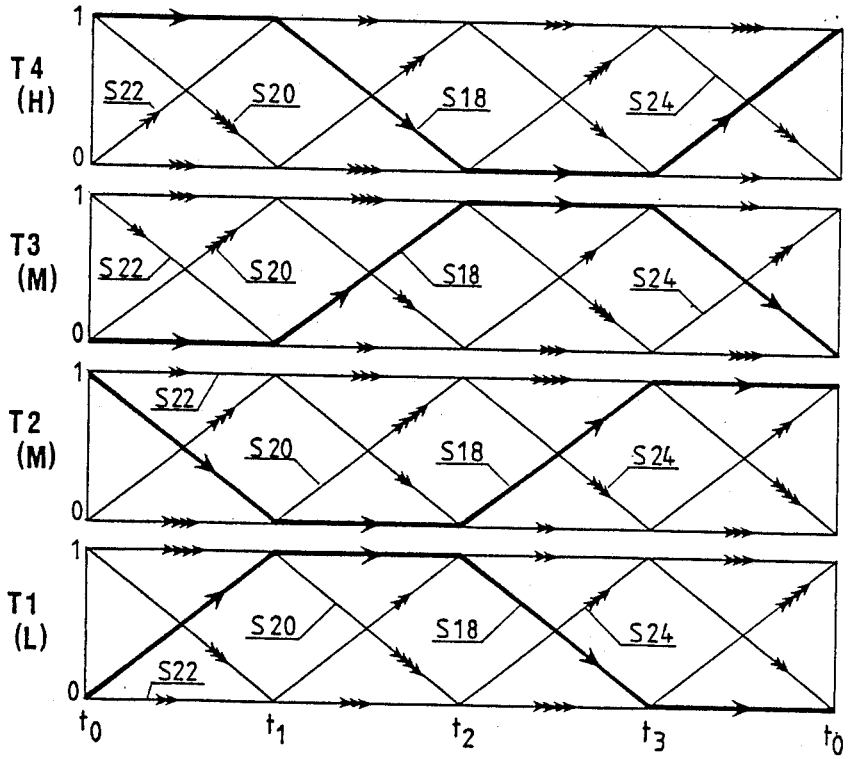
Figure 3:
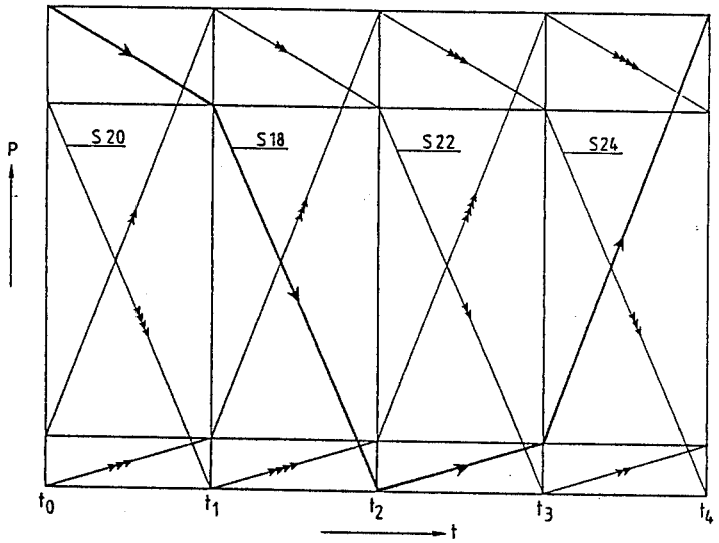

The work chambers communicating through the duct (818) in the cylinders of the units (810)-(816) form a first working medium system. The work chambers communicating through the duct (820) in the cylinders of the units (810) through (816) form a second working fluid system, which is fluidically separate from the first. Two different thermodynamic processes take place in the two systems, offset by 360° of crankshaft rotation, and a crankshaft rotation of 720° is required for these processes to be executed in full. The work chambers occupied by the working fluid, for example a gas such as helium, of the first system are shown in dotted shading in FIG. 11. The work chambers occupied by the working fluid of the other system are shown in white in FIG. 1. The pistons are represented by slanted shading.

The pistons preferably execute intermittent movements; that is, during a crankshaft rotation of 90° they execute one stroke at a time, and during the next 90° of crankshaft rotation they remain in the extreme position in the cylinder attained by the end of the preceding stroke movement, and the pistons of one pair of units (810, 812) move at one time, while the pistons of the other pair of units (814, 816) are in repose, and vice versa. If a certain lessening of efficiency is acceptable, then it is also possible to operate with a sine-wave-like stroke movement of the pistons.

Figures 11A, 11B, 11C, 11D:
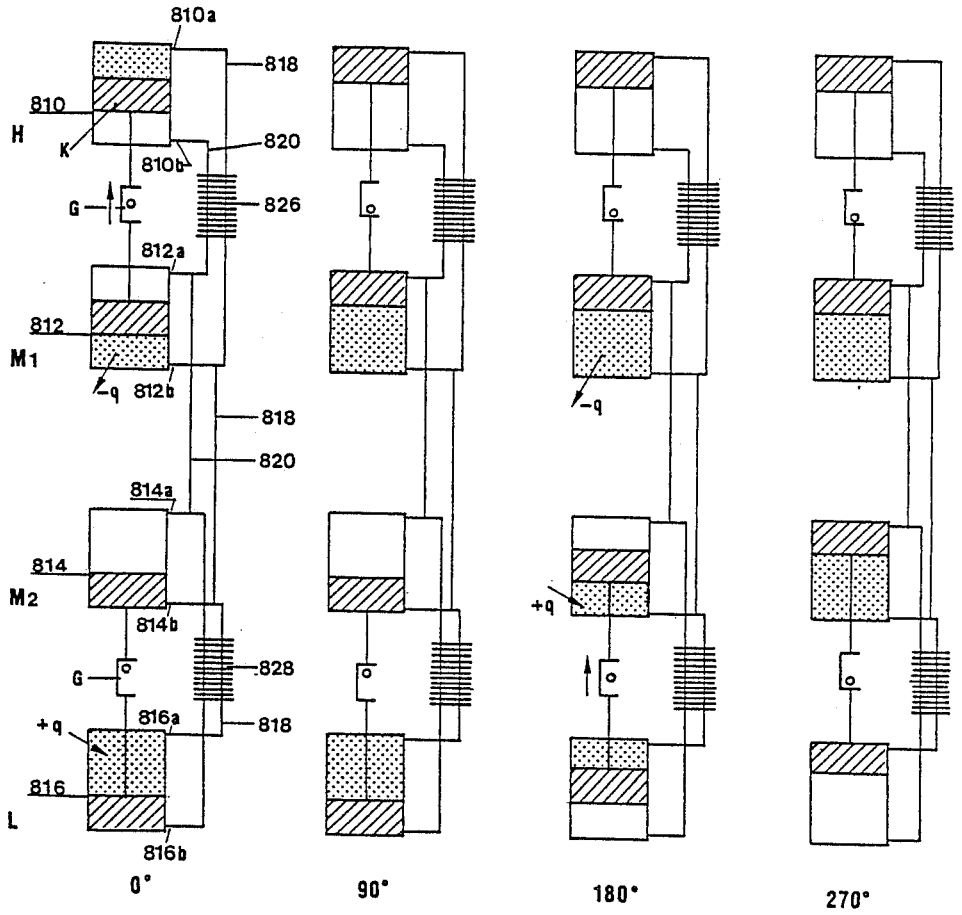
Figure 12:
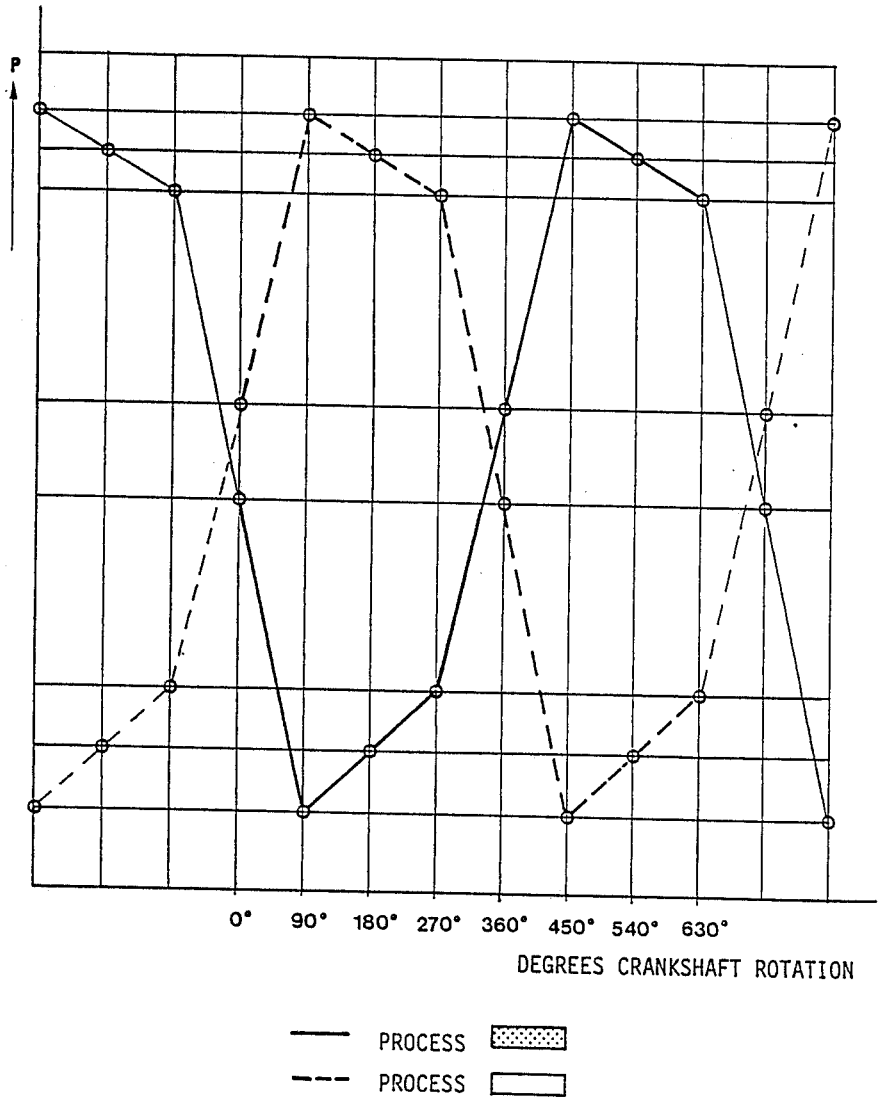

In the state shown in FIG. 11*a*, the pistons of the units (810) and (812) are located in the middle of their upward stroke, in which hot working fluid of the first system (system A having work chambers shaded with dotted shading; process curve shown as a solid line in FIG. 12) associated with the duct (818) is positively displaced into the lower portion of the unit (812) that is at the medium temperature level ($M_1$). At the same time, working fluid that is at medium temperature in the system associated with the duct (820) (system B having white work chambers; process curve shown in dashed lines in FIG. 12) is positively displaced out of the upper portion of the unit (812) into the lower portion of the "hot" unit (810). The positively displaced working fluids of the two systems exchange heat in the heat exchanger (826). Because of the lowering of temperature, the pressure in the system (A) drops, as the curve in FIG. 12 between −90° and +90° shows.

At 90° (FIG. 11*b*), the pistons have attained their extreme position.

In the range from 90° to 270°, the pistons are at rest in units (810) and (812), while the pistons in the units (814) and (816) execute an upward stroke movement (FIGS. 11*b*–11*d*). The cold working fluid of the system (A) is positively displaced out of the "cold" unit (816) into the unit (814) that is at a medium temperature level ($M_2$). As a result the pressure in the system (A) rises, as the curve in FIG. 12 between 90° and 270° indicates; however, because of the relatively slight temperature difference between the temperature levels of the units (816) and (814), the temperature rise is relatively small. At the same time the working fluid of the system (B) is positively displaced out of the unit (814) into the unit (816).

Figure 11E:
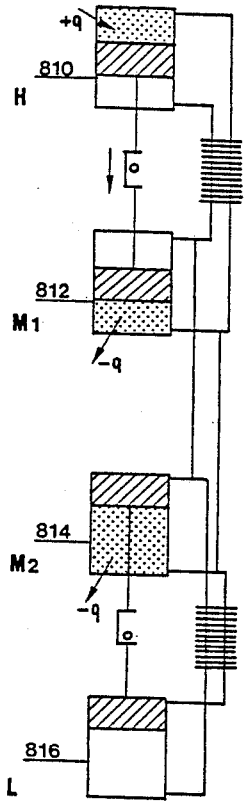

In the range from 270° to 450°, the pistons of the units (810) move downward (FIG. 11*e*), so that the working fluid that is at the medium temperature is positively displaced out of the unit (812) into the operating unit (810) that is at a higher temperature. At the same time, hot working fluid of system (B) is positively displaced out of the unit (812) into the unit (810). Once again, a heat exchange takes place in the heat exchanger (826). The pistons in the units (814) and (816) are at rest between 270° and 450° (FIGS. 11*d*–11*f*).

Figure 11F:
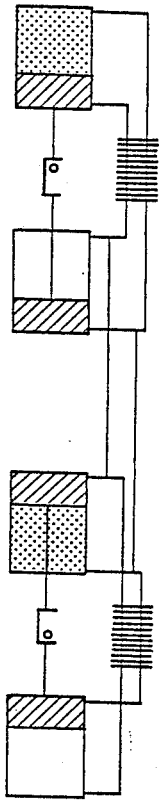
Figure 11G:
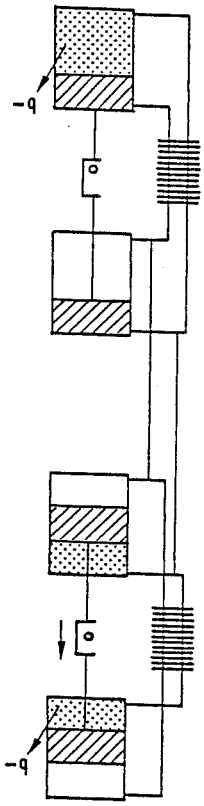
Figure 11H:
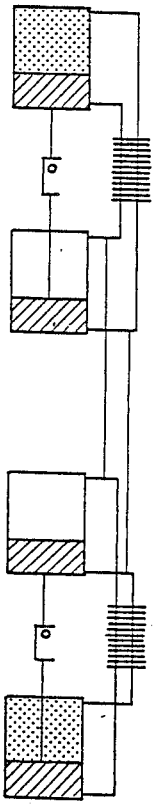

In the range between 450° and 630° of crankshaft rotation, the pistons in the units (810) and (812) are at rest, while the pistons of the units (814) and (816) move upward (FIGS. 11*f*–11*h*). In the range between 630° and 90° of the next cycle, the pistons of the units (810) and (812) then move upward once again, while the pistons in the units (814) and (816) are at rest. The processes of positive displacement, heating and cooling that elapse here should need no further explanation.

Figure 13:
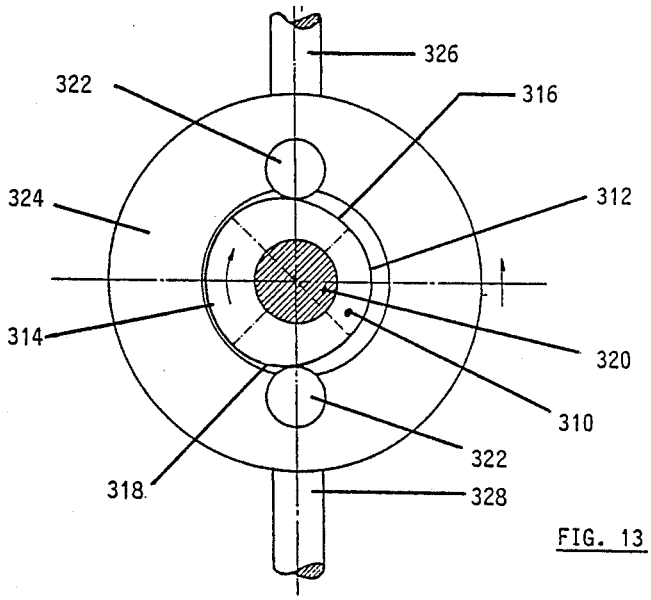
Figure 5A:
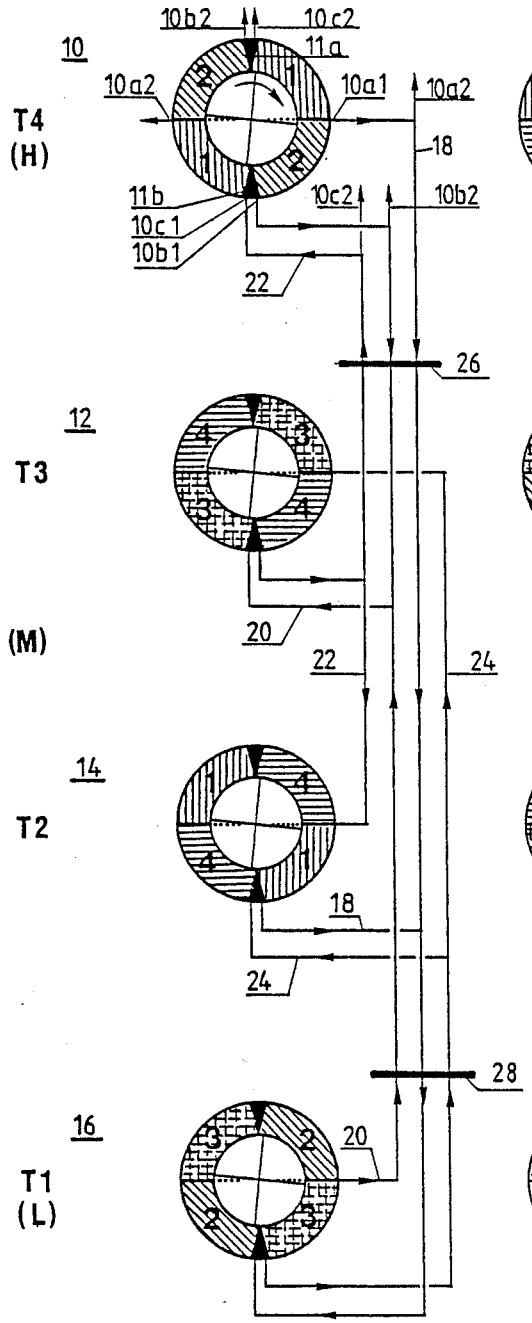
Figure 5B:
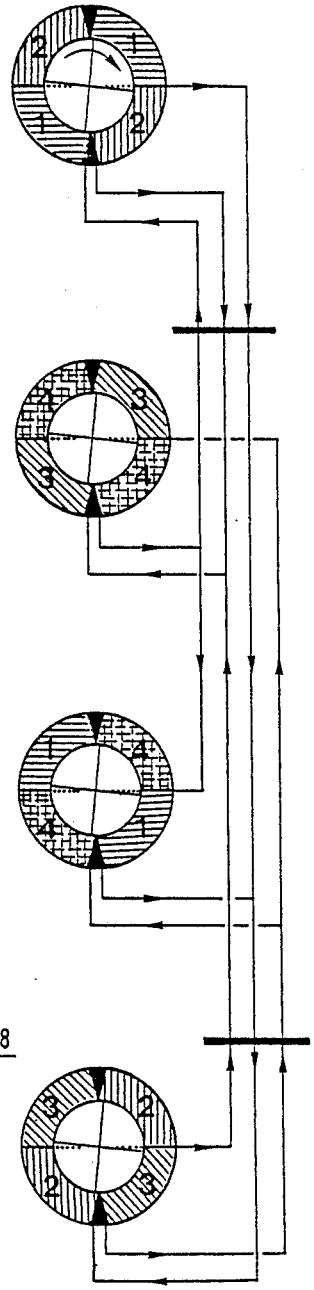
Figure 5C:
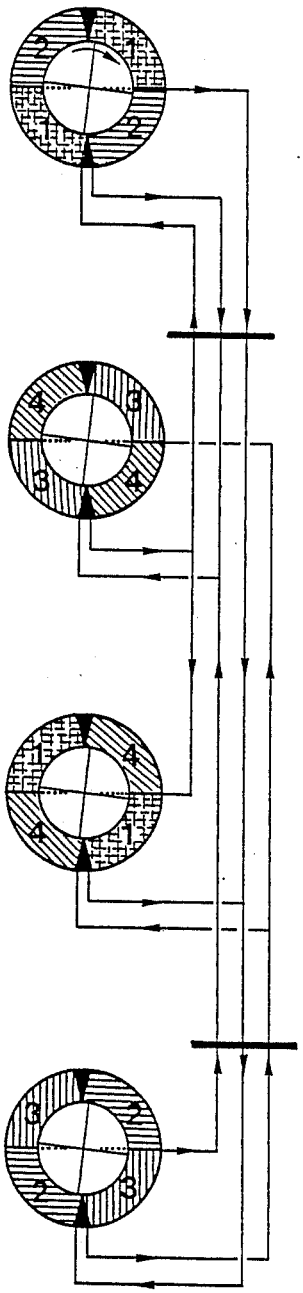
Figure 5D:
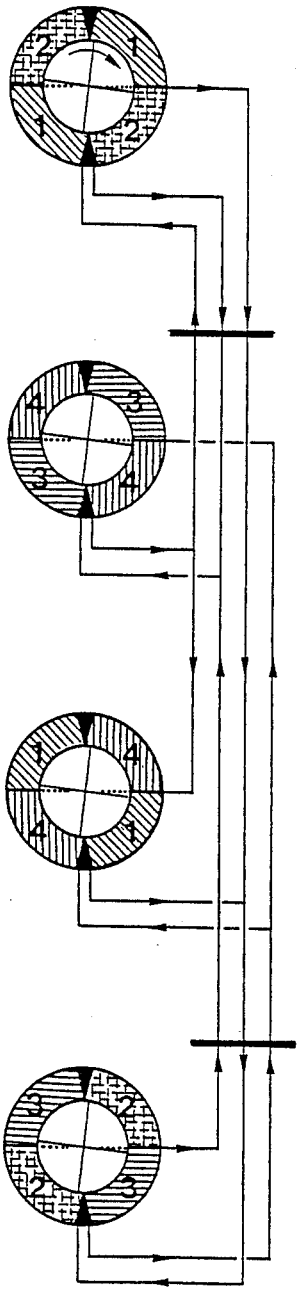
Figure 6A:
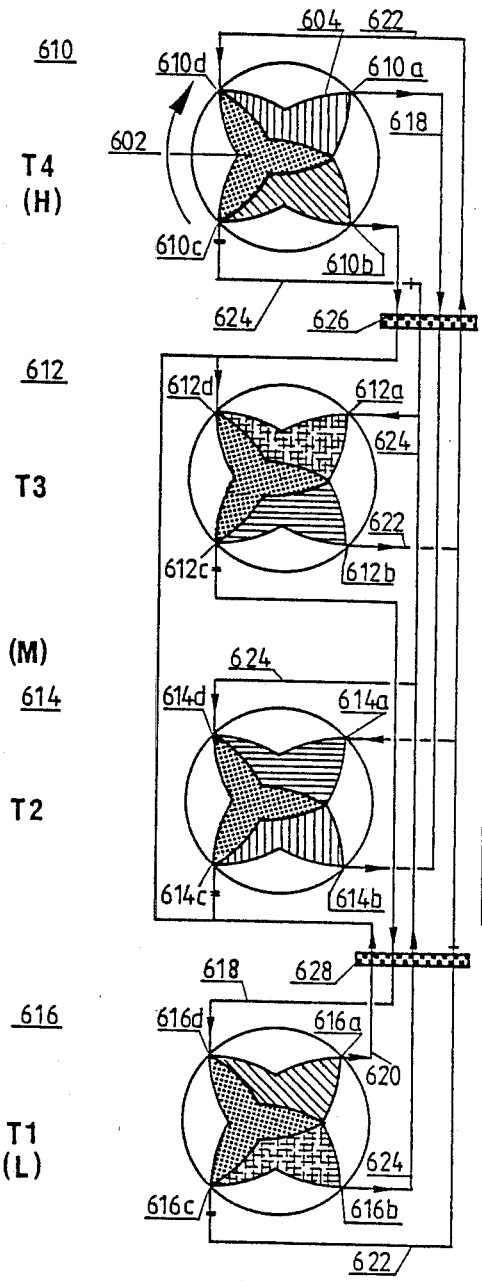
Figure 6B:
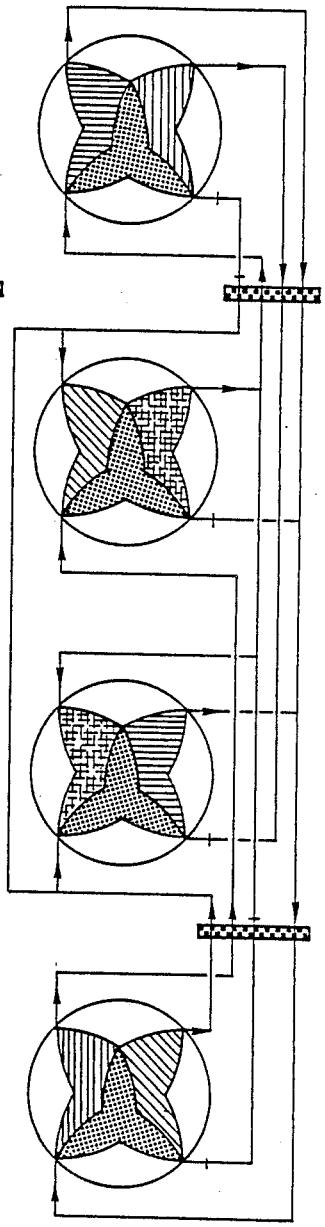
Figures 6C, 6D:
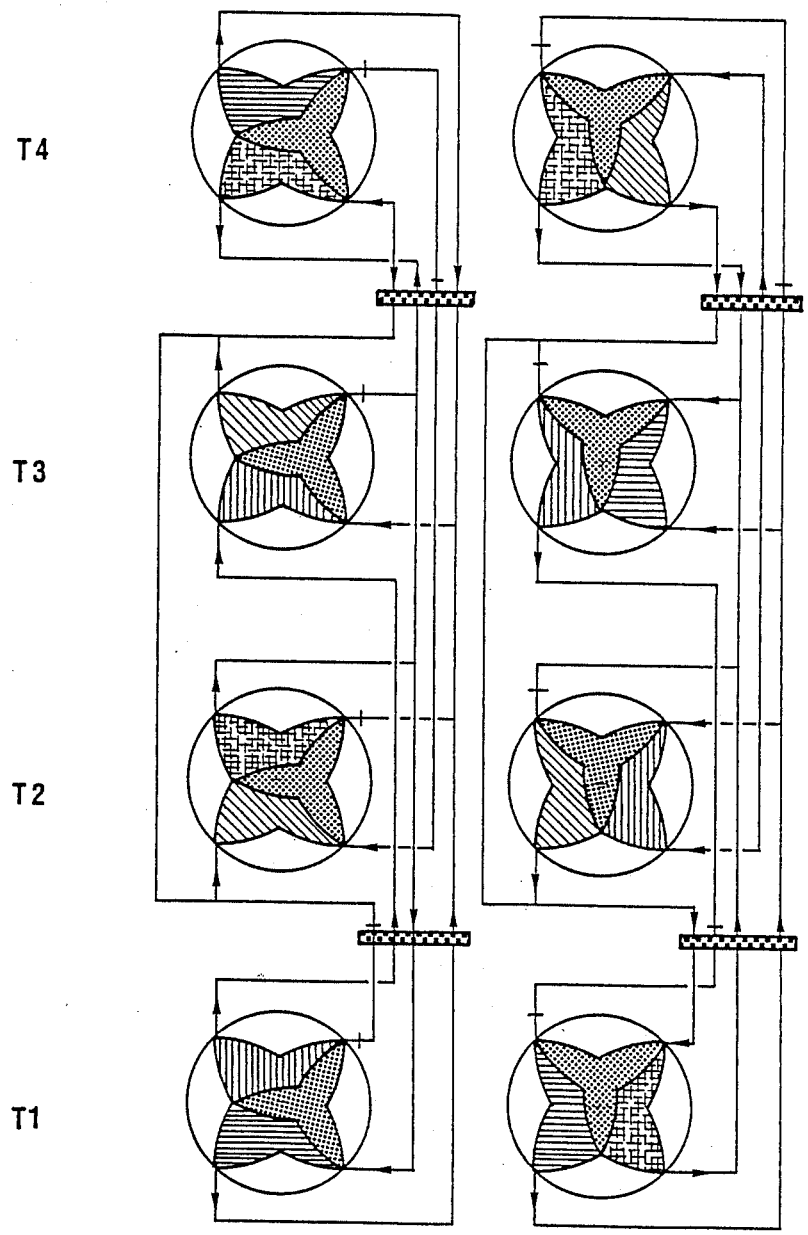
Figure 7A:
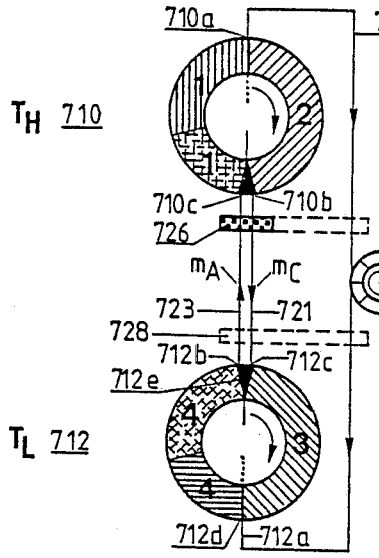
Figure 7B:
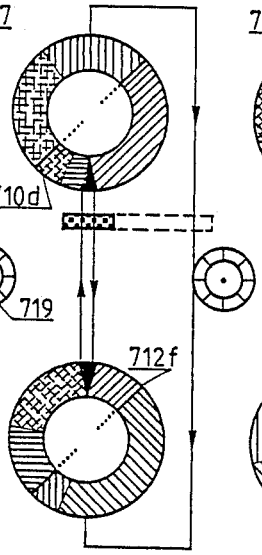
Figure 7C:
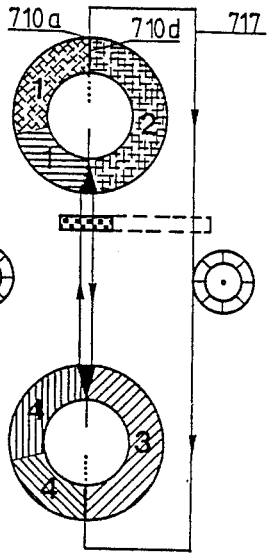
Figure 7D:
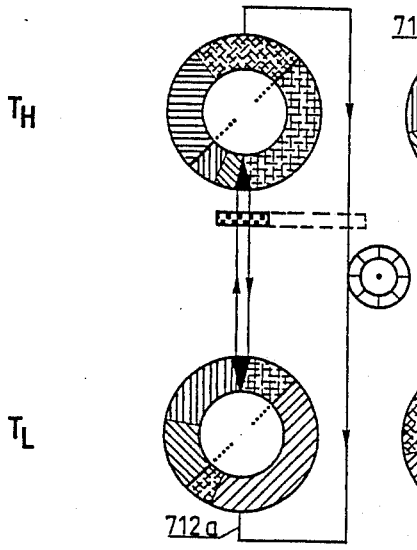
Figure 7E:
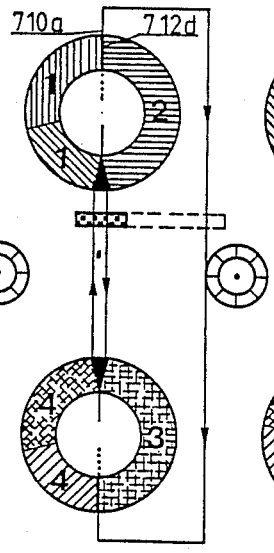
Figure 7F:
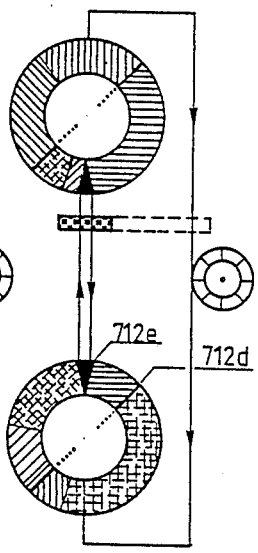
Figures 7G, 7H, 7I:
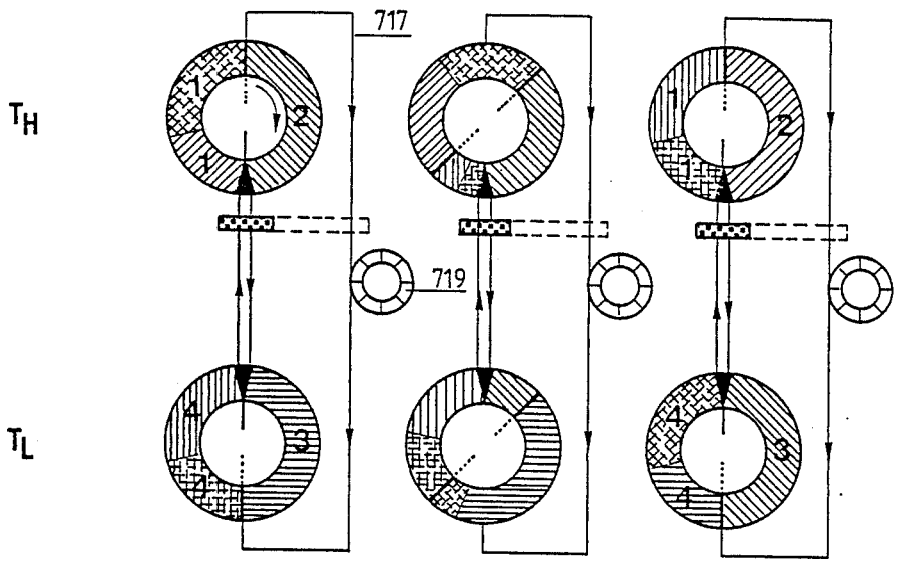
Figure 8:
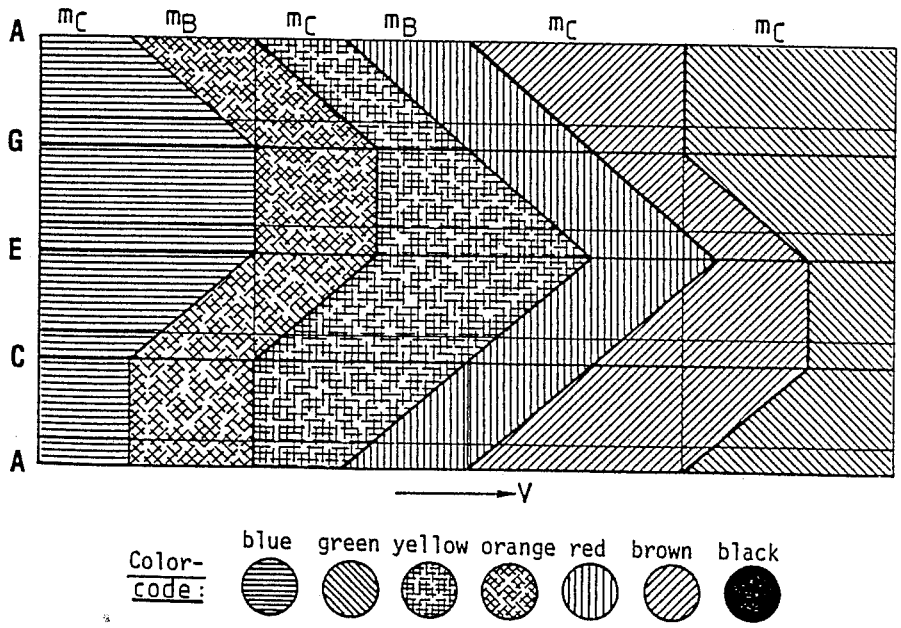
FIG. 8 shows how the volumes of the various gas masses vary during one operating cycle, the same color representations or shadings being used as in FIG. 7.
Figure 10:
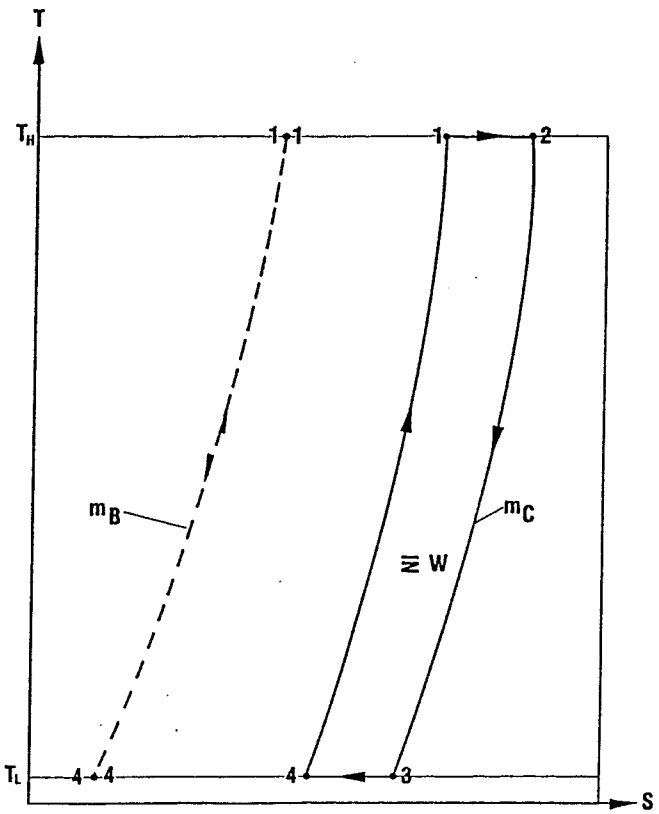
Figure 9:
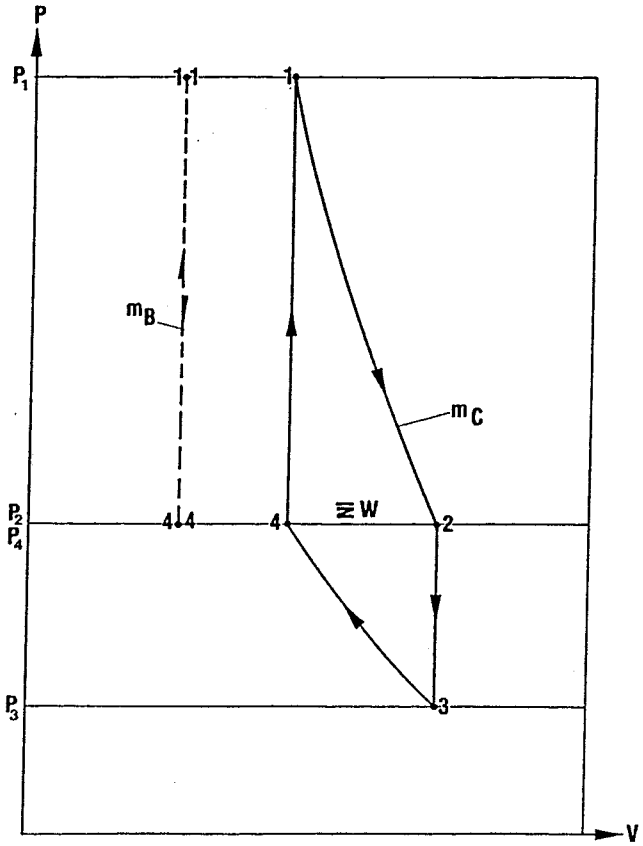
FIG. 9 shows the indicator diagram of the shuttling mass ($m_C$), which performs the primary work by pressing the working mass ($m_B$) through the turbine. The indicator diagram of the working mass ($m_B$) flowing through the turbine and finally generating the shaft output of the turbine is indicated only by the extreme points 1 and 4.

For driving a pair of pistons, coupled to one another, of two units a gear unit such as that shown in FIG. 13 can advantageously be used. This gear unit includes a cam disk (910), the circumferential face of which has two circular faces (312, 314) that are concentric with its axis, and which occupy two quadrants opposed to one another and are joined by two extending sections (316, 318). The cam disk (310) is mounted on a driven shaft (320). Two pickup members (322) engage radially opposed points of the cam disk (910), comprising rotatably supported rollers and being mounted in an annular body (324), which at diametrically opposed points are each connected with a respective piston rod (326, 328), which controls the pistons of two associated units, such as (810, 812) or (814, 816). The cam disks of the drive apparatuses for the pairs of units (810, 812) or (814) are offset from one another by 90°.

If the pistons are driven in the manner described in conjunction with FIG. 11, the installation of FIG. 11 operates as a heat pump or refrigerating machine. The unit (810) is supplied with heat at relatively high temperature, while the unit (816) receives heat at relatively low temperature (cooling heat or heat to be pumped to a higher temperature). The units (812, 814) give up heat at a medium temperature (heat for heating purposes, or waste heat).

If the direction of the heat flows and of the flows of working medium are reversed, for example by corresponding reversal of the drive direction of the individual units, then the installation of FIG. 11 functions as a heat transformer; that is, the units (812, 814) receive heat at a medium temperature level, and the unit (810) gives up "upwardly transformed" utility-system heat at a higher temperature, while from the unit (816), waste heat at relatively low temperatures must be dissipated.

The embodiment according to FIG. 11 can again be augmented, analogously to FIG. 7, by means of a rotary machine, which is then connected in between the connections (810*a*) and (816*b*). The embodiments that are made in connection with Tables I and II are also applicable.

Figure 14:
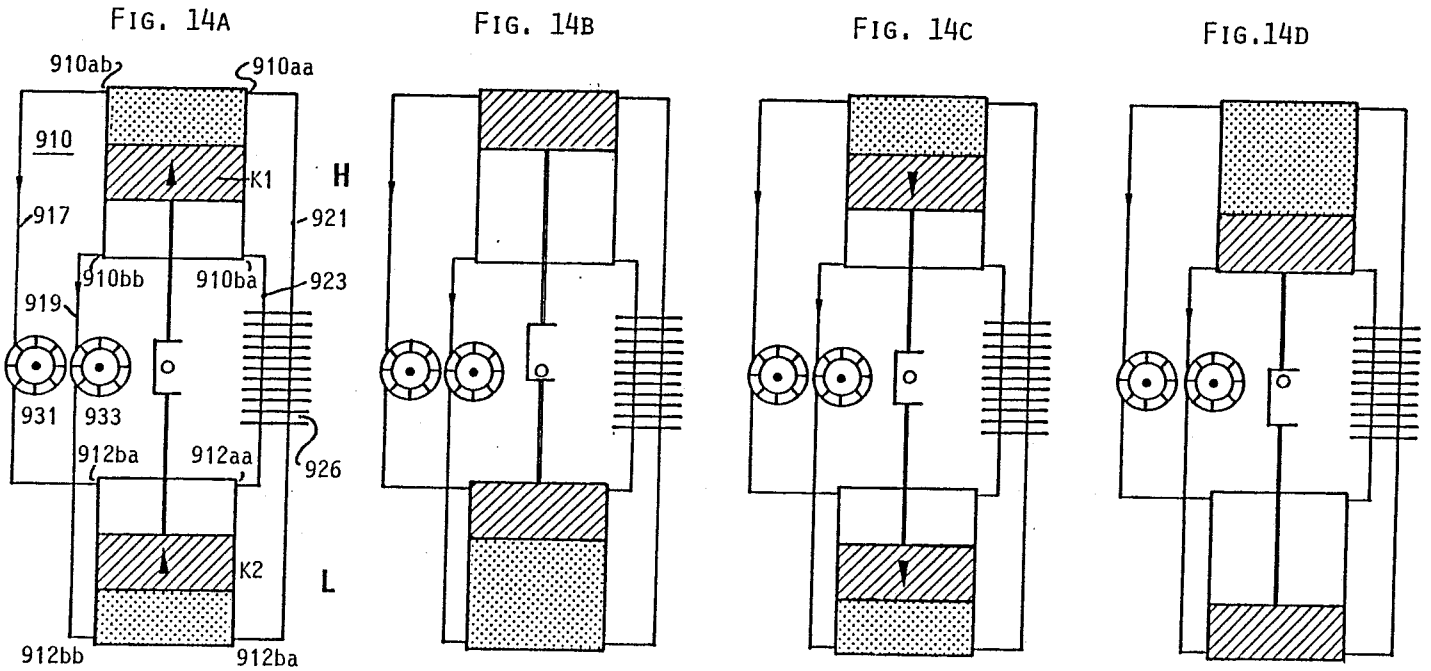

In FIG. 14, an embodiment of the invention analogous to FIG. 7 is shown, which can be used for producing mechanical work. The installation of FIG. 14, which is shown in four different phases of its working cycle in FIGS. 14*a*–14*c*, includes a first reciprocating piston engine unit (910) and a second reciprocating piston engine (912). The unit (910) includes a piston (K1), which with the housing of the unit forms two work chambers that operate at a relatively high temperature level (H). The second unit (912) includes a piston (K2), which with the housing of this engine likewise forms two work chambers, but these operate at a relatively low temperature (L). The pistons (K1 and K2) are mechanically coupled to one another, so that they move synchronously toward a first end (the upper end, in FIG. 14) of the associated housing or toward a second end (the lower end, in FIG. 14) of the associated housing). The drive apparatus may be embodied in the manner explained in conjunction with FIG. 13, but a sine-wave-like motion or other reciprocating motion can also be used.

The first, upper end of the first unit (910) is connected via a connection (910*aa*) and a working fluid duct (921) to a connection (912*ba*) at the second, lower end of the unit (912). The second, lower end of the unit (910) is also connected via a connection (910*ba*) and a working fluid duct (923) to a connection (912*aa*) at the first, upper end of the unit (912). The ducts (921, 923) can be thermally coupled to one another through a heat exchanger (926).

Furthermore, the first end of the first unit (910) is connected via a connection (910*ab*) and a third working fluid duct (917), which includes a machine such as an expansion machine, for instance, a turbine (931), to a connection (912*ba*) at the first end of the unit (912) and/or the second, lower end of the first unit (910) is connected via a connection (910*bb*) and a working fluid duct (919), which includes a second machine, such as an expansion machine, e.g., a turbine (933), to a connection (912*bb*) at the second end of the unit (912). Shaft output can be drawn from the turbines; that is, the installation according to FIG. 14 can serve as a motor. Otherwise, the description made with respect to FIG. 7 applies here as well.

By connecting in series a plurality of installations according to FIG. 14 operating out of phase with one another, a more uniform operation can be attained as desired. The corresponding turbines of the coupled installations operating out of phase can then be mounted on the same shaft.

What is claimed is:

1. An installation for harnessing thermal energy, in which in a first part of an operating cycle a working fluid is positively displaced out of a first fluid chamber into a second fluid chamber, in which a higher temperature prevails than in the first, and in the second part of the operating cycle working fluid is positively displaced from the second fluid chamber back into the first fluid chamber, wherein thermal energy is supplied to the working fluid on its passage from the first to the second fluid chamber and removed from the working fluid on its passage from the second to the first fluid chamber, said installation comprising a first reciprocating piston engine unit having a first housing and a first piston mounted for reciprocating movement in said housing, said first unit operating at a relatively high temperature level;

a second reciprocating piston engine unit having a second housing and a second piston mounted for reciprocating movement in said second housing, said second unit operating at a relatively low temperature level;

means for coupling said pistons with one another so that they each simultaneously move towards a first and second end of the associated housing;

a first working fluid duct connecting the first end of the housing of the first unit with the second end of the housing of the second unit;

a second working fluid duct connecting the second end of the housing of the first unit with the first end of the housing of the second unit;

a third working fluid duct coupling the second end of the first unit with the second end of the second unit.

2. An installation as claimed in claim 1, wherein said machine is an expansion machine performing work.

3. An installation as claimed in claim 1, wherein said machine is a compression machine receiving work.

4. An installation for harnessing thermal energy, in which in a first part of an operating cycle a working fluid is positively displaced out of a first fluid chamber into a second fluid chamber, in which a higher temperature prevails than in the first, and in the second part of the operating cycle working fluid is positively displaced from the second fluid chamber back into the first fluid chamber, wherein thermal energy is supplied to the working fluid on its passage from the first to the second fluid chamber and removed from the working fluid on its passage from the second to the first fluid chamber, said installation comprising a first reciprocating piston engine unit having a first housing and a first piston mounted for reciprocating movement in said housing, said first unit operating at a relatively high temperature level;

a second reciprocating piston engine unit having a second housing and a second piston mounted for reciprocating movement in said housing, said second unit operating at a relatively low temperature level;

means for coupling said pistons with one another so that they each simultaneously move towards a first and second end of the associated housing;

a first working fluid duct connecting the first end of the housing of the first unit with the second end of the housing of the second unit;

a second working fluid duct connecting the second end of the housing of the first unit with the first end of the housing of the second unit;

a third working fluid duct coupling the first end of the first unit with the first end of the second unit;

a machine coupled into said third fluid duct.

5. An installation as claimed in claim 4, wherein said machine is an expansion machine performing work.

6. An installation as claimed in claim 4, wherein said machine is a compression machine receiving work.

7. An installation for harnessing thermal energy, in which in a first part of an operating cycle a working fluid is positively displaced out of a first fluid chamber into a second fluid chamber, in which a higher temperature prevails then in the said first, and in a second part of the operating cycle working fluid is positively displaced from said second fluid chamber back into said first fluid chamber, wherein thermal energy is supplied to the working fluid on its passage from said first to said second fluid chamber and removed from the working fluid on its passage from said second to said first fluid chamber, said installation comprising first and second rotary machine units, each of said units being of a type including (a) a housing having a rotor chamber, (b) a rotor rotatably mounted in said rotor chamber; said rotor having at least one pair of diametrical elements that effect sealing with respect to said housing, (c) at least one sealing device stationary with respect to said housing and provided between said housing and said rotor;

said rotor chamber having at least one trio of first, second and third connections for working fluid ducts, of which the first has an angular spacing from said at least one sealing device, the spacing being equal to 180° divided by the number of the sealing devices, and the second and the third connection at a given rotor rotational direction, are located immediately in front of and immediately behind, respectively, said at least one sealing device;

said rotor and said at least one sealing device defining within said rotor chamber at least first and second variable-volume work chamber, each of said work chambers forming one of said fluid chambers, driving means for operating said rotary machine units out of phase with one another, fluid duct means coupled to said connections in such a way that the working fluid is positively displaced out of a shrinking work chamber having a relatively high temperature through a first duct, into an expanding work chamber having a lower temperature, and at the same time, working fluid from a shrinking work chamber having a lower temperature is positively displaced through a second duct into an expanding work chamber having a higher temperature; the housing of each rotary machine unit operating as a whole at substantially the same temperature level and substantially the same temperature level prevailing in the work chambers formed in said housing, and the housings of first and second rotary machine units are arranged to operate at different temperatures.

8. An installation as defined by claim 7, further comprising third and fourth rotary machine units of said type, the first connection of the first unit being connected by means of a branching working fluid duct with both the second connection of the third unit and the third connection of the fourth unit; the first connection of the second unit being connected via a second branching working fluid duct with both the second connection of the fourth unit and the third connection of the third unit; the first connection of the third unit being connected via a third working fluid duct with both the second connection of the second unit and the third connection of the first unit; and the first connection of the fourth unit being connected via a fourth working fluid duct with both the second connection of the first unit and the third connection of the second unit.

9. An installation as defined by claim 8, wherein the portion of the first duct adjoining the first connection of the first unit as well as the portions of the third and fourth duct adjoining the second and third connection of the first unit and thermally coupled with one another through a first heat exchanger, and that the portion of the fourth duct adjoining the first connection of the fourth unit as the portions of the first and second ducts adjoining the second and third connections of this unit are thermally coupled with one another through a second heat exchanger, that the portion of the first duct adjoining the third and fourth units and the portion of the second duct adjoining the first connection of the second unit are thermally coupled with one another through a heat exchanger, and that the portion of the third duct adjoining the third unit and the portion of the fourth duct adjoining the first and second units are thermally coupled with one another through a heat exchanger.

10. An installation as claimed in claim 7, wherein there is provided, in the portion of the first duct adjoining the first connection of the first unit, a machine selected from the group consisting of:

a compression machine which receives work, and an expansion machine which performs work.

11. An installation as claimed in claim 10, wherein there is provided, in the portion of the fourth duct adjoining the first connection of the fourth unit, a machine selected from the group consisting of:

a compression machine which receives work, and an expansion machine which performs work.

12. An installation as defined by claim 7, further characterized in that the first connection of the first unit is connected to the first connection of the second unit via a machine which performs work, that the second connection of the first unit is connected via a working fluid duct with the third connection of the second unit, and that the third connection of the first unit is connected via a third working fluid duct with the second connection of the second unit.

13. An installation as defined by claim 8, further characterized by means for removing thermal energy at relatively high temperature from said first unit; means for supplying thermal energy at a medium temperature range to said second and third units, and means for removing thermal energy at relatively low temperature from said fourth unit, so that the installation operates as a heat transformer.

14. An installation as defined by claim 8, further comprising for operation of the installation as a heat pump transformer, means for supplying thermal energy of a second-highest temperature level of four successive lower temperature levels to said first unit; means for removing thermal energy at the highest temperature level from said second unit; means for supplying thermal energy at the third-highest temperature level to said third unit and means for removing thermal energy at the lowest temperature level from said fourth unit.

15. An installation as defined by claim 8, further comprising for operation of the installation as a heat pump transformer; means for removing thermal energy of a highest temperature of four successive lower temperature levels from the first unit; means for supplying thermal energy at a second-highest temperature level to the second unit; means for removing thermal energy at a lowest temperature level from the third unit; and means for supplying thermal energy at a third-highest temperature level to the fourth unit.

16. An installation as claimed in claim 7, wherein there is provided, in the portion of the fourth duct adjoining the first connection of the fourth unit, a machine selected from the group consisting of:

a compression machine which receives work, and an expansion machine which performs work.

17. An installation for harnessing thermal energy, in which in first part of an operating cycle working fluid is positively displaced out of a first fluid chamber into a second fluid chamber, in which a higher temperature prevails than in the first, and in a second part of the operating cycle working fluid is positively displaced from the second fluid chamber back into the first fluid chamber, wherein thermal energy is supplied to the working fluid harness passage from said first to said second fluid chamber and removed from the working fluid on its passage from said second to said first fluid chamber, said installation comprising first, second, third and fourth reciprocating piston engines of a type including (a) a housing operating as a whole at substantially the same temperature level;

(b) a piston mounted from the reciprocating movement in said housing and defining with said housing a pair of said fluid chambers;

each housing having first and second fluid duct connections leading to different fluid chambers of the respective pair of fluid chambers;

means for coupling the pistons of a first pair of said units with one another in such a way that the each move synchronously in the direction towards the respective first working fluid duct connection or second working fluid duct connection;

means for coupling the pistons of a second pair of said units with one another in such a way that they move synchronously towards said respective first working fluid duct connection or second working fluid duct connection of the respective units of said second pair;

driving means for operating said pairs of piston engine units out of phase with one another;

a first working fluid duct connecting the first working fluid duct connection of said first unit, the second working fluid duct connection of said second unit, the second fluid duct connection of said third unit, and the first working fluid duct connection of said fourth unit to one another;

a second working fluid duct connecting the remaining working fluid duct connections of said units to one another.

18. An installation as defined by claim 17, wherein the portions for the working fluid ducts which join the connections of one pair of units the pistons of which are coupled with one another, are each coupled with one another through a heat exchanger.

* * * * *